US011319205B2

(12) United States Patent
Engell

(10) Patent No.: US 11,319,205 B2
(45) Date of Patent: May 3, 2022

(54) STIRRUP, COMBINATION OF STIRRUP AND LEATHER, AND USE THEREOF

(71) Applicant: Maria Terese Engell, Grue Finnskog (NO)

(72) Inventor: Maria Terese Engell, Grue Finnskog (NO)

( * ) Notice: Subject to any disclaimer, the term of this patent is extended or adjusted under 35 U.S.C. 154(b) by 7 days.

(21) Appl. No.: 16/959,893

(22) PCT Filed: Jan. 4, 2019

(86) PCT No.: PCT/EP2019/050141
§ 371 (c)(1),
(2) Date: Jul. 2, 2020

(87) PCT Pub. No.: WO2019/134957
PCT Pub. Date: Jul. 11, 2019

(65) Prior Publication Data

US 2020/0331747 A1 Oct. 22, 2020

(30) Foreign Application Priority Data

Jan. 5, 2018 (NO) ..... 20180018

(51) Int. Cl.
*B68C 3/00* (2006.01)
*B68C 1/16* (2006.01)

(52) U.S. Cl.
CPC . *B68C 3/00* (2013.01); *B68C 1/16* (2013.01)

(58) Field of Classification Search
CPC ..... B68C 3/00; B68C 1/16
See application file for complete search history.

(56) References Cited

U.S. PATENT DOCUMENTS 33,930 A 12/1861 Eagle
37,158 A 12/1862 Eagle
(Continued)

FOREIGN PATENT DOCUMENTS

DE 202014002916 U1 5/2014
DE 202014007041 U1 9/2014
(Continued)

OTHER PUBLICATIONS

Cianci, Sabino; International Search Report; PCT/EP2019/050141; dated Mar. 3, 2019; 3 pages.

*Primary Examiner* — Joshua J Michener
*Assistant Examiner* — Henry Hooper Mudd
(74) *Attorney, Agent, or Firm* — Shackelford, Bowen, McKinley & Norton, LLP

(57) ABSTRACT

The invention provides a stirrup (1), comprising a curved upper part (2) shaped to fit fully or partially around the sides and over the forefoot or boot of the rider, and a in substance straight tread (3) for supporting the sole of the forefoot or boot of the rider, wherein the stirrup comprises two or more separate structures or one single structure. The stirrup is distinguished by comprising two suspension structures (4, 5) arranged apart along the curved upper part, for arranging leather (8) for suspending the stirrup in a saddle in the respective suspension structures, wherein a medial suspension structure (4) is arranged a medial distance (14) from a vertical axis (12) through a centre point (15) of the tread (3), with the tread as oriented horizontal, of at least one third the length (13) of the tread, and wherein a lateral suspension structure (5) is arranged at or near a top point of the upper part, where the vertical axis (12) through a centre point of the tread crosses the upper part, with the tread as oriented horizontal, in horizontal direction within ⅕ of the tread
(Continued)

length. The invention also provides a combination of the stirrup of the invention and a leather, and use thereof.

7 Claims, 3 Drawing Sheets

(56) References Cited

U.S. PATENT DOCUMENTS

| | | | | | |
|---|---|---|---|---|---|
| 43,300 | A | | 6/1864 | Fichter | |
| 169,209 | A | | 10/1875 | Wagstaff | |
| 264,560 | A | | 9/1882 | Parker | |
| 469,153 | A | | 2/1892 | Lewis | |
| 740,888 | A | * | 6/1902 | May | B68C 1/16 |
| 740,688 | A | | 10/1903 | May | |
| 888,699 | A | * | 12/1907 | Ebel | B68C 3/02 |
| 1,183,843 | A | | 5/1916 | Badger | |
| 2,532,082 | A | | 11/1950 | Borst | |
| 7,073,313 | B1 | * | 7/2006 | Mullenbach | B68C 3/00 54/47 |
| 9,212,044 | B2 | | 12/2015 | Nettles | |
| 2008/0047237 | A1 | * | 2/2008 | Lantuejoul | B68C 3/00 54/47 |

FOREIGN PATENT DOCUMENTS

| | | | |
|---|---|---|---|
| FR | 2873109 | A1 | 1/2006 |
| FR | 2964961 | A1 | 3/2012 |
| GB | 24591 | A | 3/1914 |
| GB | 106052 | A | 5/1917 |

* cited by examiner

STIRRUP, COMBINATION OF STIRRUP AND LEATHER, AND USE THEREOF

TECHNICAL FIELD

The present invention relates to stirrups for horse riding or training for horse riding.

BACKGROUND ART

Horse riding, also termed horseback riding or equestrianism, is known since ancient times. Currently, most of the horse riding is for pleasure or training, and machines have taken over jobs previously requiring the power of horses. However, horse riding affects people in many positive ways, physical and psychical. A positive physical effect is providing a healthier and more upright posture for the horse rider, by the rider having to balance the body position continuously. Positive psychical effects are typically related to contact with the horse and nature.

Even though horse riding still is wide spread, both as a high level performing sport and as a hobby, design improvements or design alternatives for stirrups are few.

A stirrup is suspended from the saddle, more specifically the saddle tree, by adjustable length straps termed leathers. The term leather is used even though the adjustable length strap or straps can be made of any feasible material, including leather. A typical stirrup has the shape of a in substance inverse U, with a flat tread closing the opening between the legs of the U. The flat tread, also termed the base, is at least as wide as the foot or boot forefoot of the rider. An alternative description of the shape is bell shaped or arc shaped with a flat base for the tread. A general description of the shape of a stirrup is a flat tread and a curved top. Some stirrups are one-leg stirrups, meaning that one side of the inverse U, that is one leg, has an opening.

The stirrup is suspended by the leather at the top of the inverse U.

A prior art stirrup is described and illustrated in the patent publication U.S. Pat. No. 9,212,044 B2, as a "Variable angle riding stirrup". Said patent describes a variable angle stirrup support for supporting a stirrup in a stirrup leather so the support is hidden by the stirrup leather and does not change the aesthetics of a stirrup, comprising:

a stirrup support bracket comprising a transverse support surface for supporting a stirrup in the lower end loop of a stirrup leather;

a stirrup hanger rod support sleeve positioned above the transverse support surface of said stirrup support bracket and the lower end loop of said stirrup leather for attaching the variable angle stirrup support to a stirrup; and a stirrup hanger support member connecting the hanger rod support sleeve to the stirrup support bracket and comprising a pivot pin positioned above the lower end loop of the stirrup leather to allow the stirrup support bracket and the stirrup to pivot about a longitudinal axis between predetermined limited angles to align the tread of said stirrup with a rider's leg and foot.

The effect is a stirrup maintaining alignment with a rider's leg and foot with a stirrup leveling mechanism and supporting a stirrup in a stirrup leather so the stirrup leveling mechanism is hidden by the stirrup leather and does not change the aesthetics of the stirrup. In other word, the stirrup orients itself automatically to "the most comfortable position". This implies that any momentum from the foot will effect an automatic pivoting rotation about a longitudinal axis parallel to the longitudinal axis of the horse, to "the most comfortable position".

Another stirrup designed so that the stirrup can pivot about a longitudinal axis relative to the longitudinal axis of a horse, is described and illustrated in U.S. Pat. No. 169,209 issued Oct. 26, 1875. Another example is U.S. Pat. No. 2,532,082, issued Nov. 29, 1950, which describes and illustrates an upper pivot pin generally parallel to the longitudinal axis of a horse and a lower pivot pin generally perpendicular to the longitudinal axis of a horse, when riding.

Other stirrups are described and illustrated in the patent publications FR 2964961A1, FR 2873109A1, U.S. Pat. No. 740,888A, 469,153A, 43,300 A, 888,699A, 264,560A, 37,158A, 33,930A and DE 2020140070 U1.

The above-mentioned stirrups according to prior art have one function in common, namely mechanisms that orient or align the stirrup automatically in a position or orientation eliminating bending forces or momentums acting on the foot of the rider, in theory providing tension free stirrups for the rider.

In the modern world, many people do not have a natural or healthy posture or orientation of body segments; including bones and joints. Foot overpronation, when the person is standing and walking more on the inside of the foot, is a generalized problem in the modern world. Walking in substance only on flat, hard surfaces may be a reason, since hard, flat surfaces are not so dominant in the natural world where humans evolved. This is also a problem often seen during riding.

A stirrup that may improve the foot posture while riding and prevent overpronation will most certainly have a positive effect on health and performance. The objective of the present invention is to provide such stirrup.

SUMMARY OF INVENTION

The invention provides a stirrup comprising a curved upper part shaped to fit fully or partially around the sides and over the forefoot or boot of the rider, and a in substance straight tread for supporting the sole of the forefoot or boot of the rider, wherein the stirrup comprises two or more separate structures joined together or one single structure.

The stirrup is distinguished by comprising two suspension structures arranged apart along the curved upper part, for arranging leather for suspending the stirrup in a saddle in the respective suspension structures, wherein a medial suspension structure is arranged a medial distance from a vertical axis through a centre point of the tread, with the tread as oriented horizontal, of at least one third the length of the tread, and wherein a lateral suspension structure is arranged at or near a top point of the upper part, where the vertical axis through a centre point of the tread crosses the upper part, with the tread as oriented horizontal, in horizontal direction within ±1/5, more preferably within ±1/8 or ±1/10 of the tread length from where the vertical axis crosses the upper part.

The structure of the stirrup is designed for rotation in "roll" of the whole stirrup, that is rotation around an axis perpendicular through the stirrup, said axis in substance being parallel to a longitudinal axis through the body of the horse or simulated horse, from shoulder to tail. The right foot stirrup can be "rolled" clockwise and the left foot stirrup can be "rolled" anti-clockwise, as seen from behind the horse or simulated horse.

No other stirrup apparently exists, designed for rotation of the whole stirrup around an axis through the stirrup. Said rotation is termed "roll", likewise as for ships and airplanes.

The term suspension structure means a structure for fastening a leather or leather strand, fixed or adjustable, for suspending the stirrup. The position of a suspension structure is meant as the point representing a resultant force on the suspension structure. A medial distance is a distance along a horizontal axis on the inside towards the horse. A lateral distance is a distance along a horizontal axis on the outside away from the horse. The centre point of the tread is a centre point of the length along the tread, irrespective of the tread being horizontally oriented or slightly rotated.

More than 70% of the population above age 12 has overpronation in the feet, many of whom are riding. For riders having an overpronation problem, acknowledged or unknown, the stirrup of the invention can provide a correcting effect.

The result is better posture, by adjusting foot position by the stirrup, achieved since the muscles, bones and further structure upwards of the body is affected by the corrective effect of the stirrup. If pain related to poor foot orientation is a problem for the rider, less pain is a typical result. An overpronated foot and leg naturally takes a position not ideal for riding. The stirrup of the invention adjusts the position of the foot and leg in a direction more optimal for riding, by improved contact with the horse along the full length of the foot, thereby allowing more efficient use of the legs as an aid for giving instructions to the horse. The rider may experience to use and train muscles, ligaments and joints otherwise than earlier. More specifically, it is assumed that tension is moved from the muscle peroneus tertius on the lateral side of the foot to muscles medially inwards, distributing the tension to core muscles and muscles medially inwards in the lower limb. When the tension is balanced in the foot and lower leg, the balance and coordination of upper body segments may also be. Until the stirrup of the present invention, the solution to mitigate the problems caused by severe tension has been a wider tread of the stirrup, the wider tread distributing the tension on the base of the foot, but not providing corrective effect on the underlying problem. Also, the stirrup of the invention preferably includes a wide or wider tread.

The present invention is as defined in the independent claims.

Preferable embodiments are defined in respective dependent claims.

DETAILED DESCRIPTION OF THE INVENTION

Figure 1:
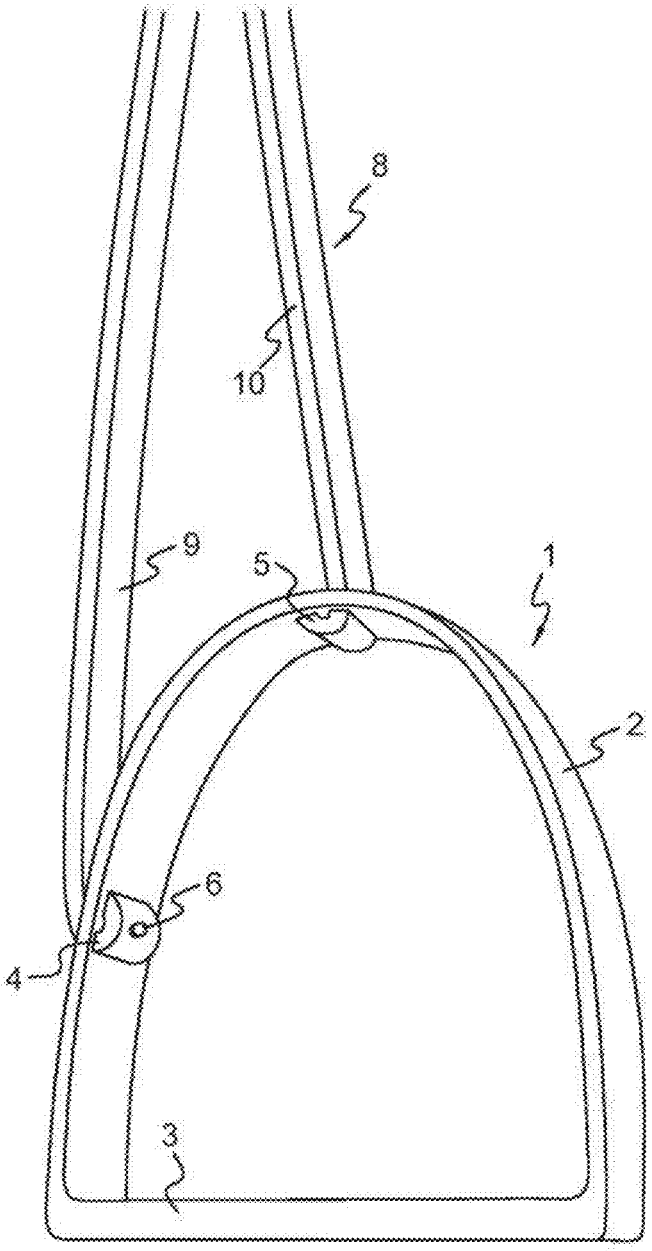
FIGS. 1 to 3 illustrate a preferable embodiment of a stirrup of the invention.
Figure 2:
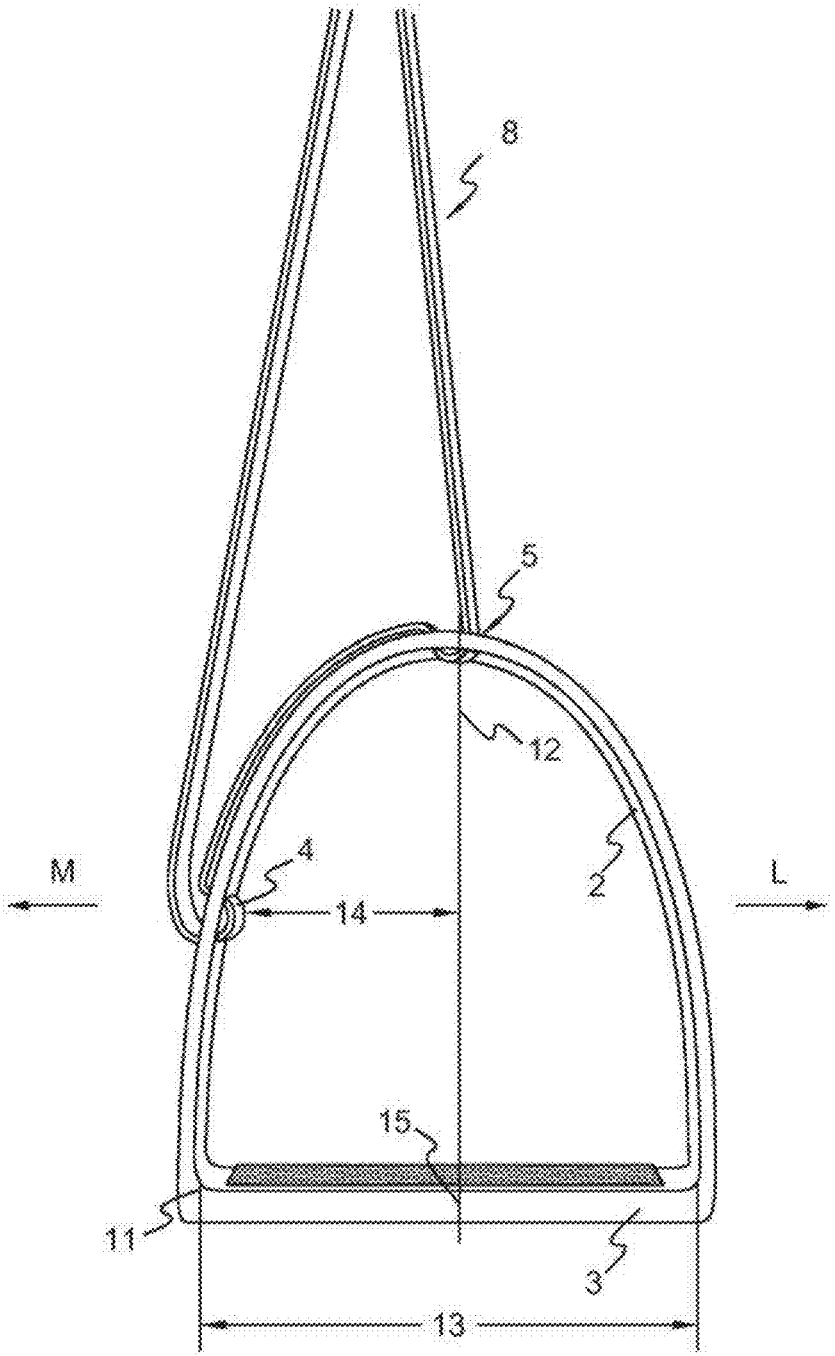
Figure 3:
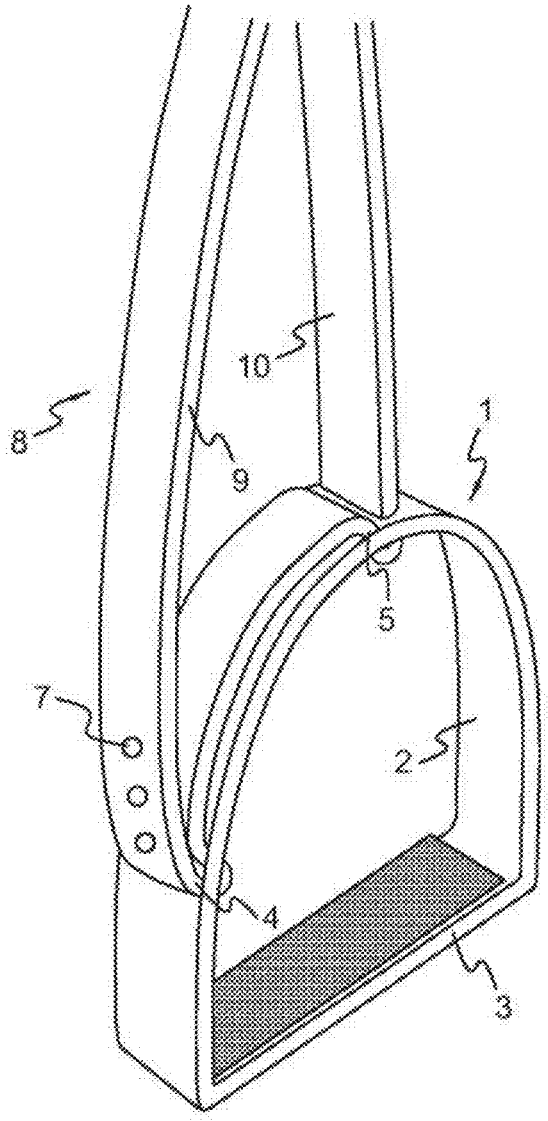

Reference is made to FIGS. 1, 2 and 3, illustrating an embodiment of a stirrup 1 of the invention. The stirrup 1 comprises a curved upper part 2 shaped to fit fully or partially around the sides and over the forefoot or boot of the rider, and a in substance straight tread 3 for supporting the sole of the forefoot or boot of the rider. In the illustrated embodiment the stirrup is one single structure. In other embodiments, the stirrup can comprise two or more separate structures joined together. The stirrup comprises two suspension structures 4, 5 arranged apart along the curved upper part, for arranging leather 8 for suspending the stirrup in a saddle, wherein an inner or medial suspension structure 4 medial to the horse as seen with the stirrup oriented for riding, is arranged a medial distance 14 from a vertical axis 12 through a centre point 15 of the tread 3 of at least one third the length 13 of the tread, with the tread in horizontal orientation and the axis 12 vertically up from the midpoint of the tread. In FIG. 2, the medial direction is illustrated with an arrow and an M, whilst the lateral direction is illustrated with an oppositely directed arrow and an L.

Accordingly, the medial distance 14 from the vertical axis 12 through the centre point 15 of the tread 3 as oriented horizontal, is at least one third the length 13 of the tread. Or with other definition: the length of 14≥⅓ x the length of 13.

The illustrated stirrup comprises two suspension structures; an upper or outer or lateral suspension structure 5, preferably at or near a top point of the upper part when the stirrup is suspended, and an inner or medial suspension structure 4 in an arm of the stirrup facing the horse, medial to the horse. The stirrup can comprise more than two suspension structures, such as three, four or five suspension structures, improving the versatility for different riders.

The curved upper part 2 can be assumed to have two arms, above a horizontal tread; a medial arm medial to a top point and a lateral arm lateral to the top point. The inner suspension structure 4 is then preferably arranged in the medial arm, a distance from the top point, along the arm, of at least one third of the arm length, preferably about equal to or longer than half the arm length. In FIG. 2, the upper suspension structure 5 is at the top point of the upper part when the stirrup is suspended, and an inner suspension structure 4 in the medial arm of the stirrup facing the horse. The full length along the arm medial to the horse, is the distance along the arm from 5 to 11. Accordingly; in terms of distance along the arm 5 to 4 is longer or equal to ⅓ of 5 to 11. Or the distance 5–4≥⅓ x the distance 5-11.

Preferably, when riding, the upper suspension structure and the inner suspension structure are on either side of a resultant force vector down from the foot of the rider, as seen vertically down along the gravity vector, preferably at least one third the length of the tread or width of foot or sole of the forefoot apart, for a comfortable force distribution. It is remarked that during riding with stirrups of the invention, the right foot stirrup typically rotates slightly clockwise and the left foot stirrup rotates slightly anticlockwise, as seen from behind the horse or horse simulator. The lateral or upper suspension structures can be arranged slightly medial, that is within ⅕, ⅛ or 1/10 tread length, to the top point right above the center of the tread as oriented horizontal, where the vertical axis 12 crosses the upper part 2, but due to said rotation, still lateral to said force vector.

The tread 3 can be horizontal in a symmetrical stirrup about a vertical axis normal up from a center point 15 of the tread to a top point of the upper part 2. However, the tread can be rotated slightly clockwise, for the right foot stirrup as seen from behind in the normal direction of riding. Unlike prior art stirrups, the rotation about the normal riding direction, termed x, parallel to the longitudinal axis of the horse, will not self-rotate about x to a position eliminating any momentum forces. The suspension structure, with properly adjusted leathers, ensure a controllable rotation about x. The suspension structure can be slots, hinges, bolts, ears or other structure for attaching and optionally fixing the leather or strand.

The inner suspension structure 4 is arranged in an arm of the stirrup medial to or facing the horse and measured along a normal axis 12 from the tread 3 to an upper point 5 of the curved upper part, the distance of the inner suspension structure is preferably less than two thirds, preferably about half, more preferably less than half the distance of said normal distance. The elevation of 4 along the axis or line 12 from the tread 3 is <⅔ x the distance from 3 to 5.

At least one of the suspension structures comprises a locking knob 6, locking pin, locking dog or other equivalent structure to fix the leather to said suspension. The locking pin 6 can be arranged through a hole 7 of the leather for fixing the leather to the suspension point.

Each of the illustrated suspension structures comprises two slots in the upper part, at least the inner suspension structure comprises a locking dog or locking pin for fastening a leather for support adjustably.

The leather 8 comprises two separate strands or a looped leather that can be arranged as two strands, wherein one strand 9 is arranged to the inner (more medial) suspension structure and the other strand 10 is arranged to the outer (more lateral) suspension structure, the outer suspension structure is arranged laterally outside to the inner suspension structure and preferably at or near a top point of the curved upper part of the stirrup, further comprising structure for adjusting the length of each strand or/and structure for fixing at least the inner strand to the inner suspension structure, wherein the rotation of the stirrup is adjustable, discrete or in steps, or step less or continuous, for rotation about an axis in substance parallel to a length axis through the horse.

The stirrup preferably comprises a locking dog 6 or similar structure for locking, in the inner suspension structure and optionally in the outer suspension structure, the locking dog is arranged on a bar between two slots of each suspension structure, and the leather is a looped leather arranged through the slots of each suspension structure, wherein the leather has openings 7 for the locking dog or pin at distances apart and in sections convenient for locking the controlled rotation of the whole stirrup.

The invention claimed is:

1. A stirrup comprising:

a curved upper part shaped to fit fully or partially around sides and over a forefoot or boot of a rider, and a in substance straight tread for supporting a sole of the forefoot or boot of the rider;

two or more separate structures or one single structure;

two suspension structures arranged apart along the curved upper part for arranging leather for suspending the stirrup in a saddle in the respective suspension structures;

wherein a medial suspension structure is arranged a medial distance from a vertical axis through a centre point of the tread, with the tread as oriented horizontal, of at least one third a length of the tread;

wherein a lateral suspension structure is arranged at or near a top point of the curved upper part, where the vertical axis through a centre point of the tread crosses the curved upper part, with the tread as oriented horizontal, in horizontal direction within ⅕ of the length of the tread;

wherein the medial suspension structure is arranged in an arm of the stirrup medial to a horse, at a distance from the top point, along the arm, of at least one third of an arm length; and wherein the medial suspension structure is arranged in an arm of the stirrup medial to the horse and measured along a vertical distance from the tread to an upper point of the curved upper part, wherein a distance of the medial suspension structure is less than two thirds the distance of said vertical distance.

2. The stirrup according to claim 1, wherein the lateral suspension structure and the medial suspension structure, when riding, are on either side of a resultant force vector down from a foot of the rider, as seen vertically down along a gravity vector.

3. The stirrup according to claim 1, wherein the medial suspension structure is arranged in the arm of the stirrup medial to the horse, the distance from the top point, along the arm, of at least half the arm length.

4. The stirrup according to claim 1, wherein the medial suspension structure is arranged in the arm of the stirrup medial to the horse and measured along the vertical distance from the tread to the upper point of the curved upper part, wherein the distance of the medial suspension structure is less than half the distance of said vertical distance.

5. The stirrup according to claim 1, wherein at least one of the two suspension structures comprises a locking knob or a locking pin to fix the leather to the at least one of the two suspension structures.

6. The stirrup according to claim 1, wherein each of the two suspension structures comprises two slots in the curved upper part, at least the medial suspension structure comprises a locking pin for fastening the leather for support adjustably.

7. A combination of a stirrup according to claim 1 and a leather, wherein:

the leather comprises two separate strands or a looped leather that can be arranged as two strands, wherein one strand is arranged to the medial or inner suspension structure and the other strand is arranged to the lateral suspension structure, the lateral suspension structure is arranged laterally outside to the medial suspension structure and at or near a top point of the curved upper part of the stirrup, further comprising structure for adjusting at least one of the length of each strand and structure for fixing at least the medial strand to the medial suspension structure, wherein a rotation of the stirrup is adjustable, discrete or in steps, or continuous or step less, for rotation about an axis in substance parallel to a length axis through a horse on which the combination is arranged; and wherein the stirrup comprises a locking dog for locking, in the medial suspension structure and in the lateral suspension structure, the locking dog is arranged on a pin between two slots of each suspension structure, and the leather is a looped leather arranged through the two slots of each suspension structure, wherein the leather has openings for the locking dog at distances apart and in sections convenient for locking a controlled rotation of the whole stirrup.

* * * * *